US008757665B2

(12) United States Patent
Drapes et al.

(10) Patent No.: US 8,757,665 B2
(45) Date of Patent: Jun. 24, 2014

(54) INTERCHANGEABLE TWO-PIECE INSERT FOR SNOW SKI OR SNOWBOARD

(75) Inventors: Greg A. Drapes, Missoula, MT (US); Chad Komlofske, Polson, MT (US)

(73) Assignee: SkiBling, Inc., Missoula, MT (US)

( * ) Notice: Subject to any disclaimer, the term of this patent is extended or adjusted under 35 U.S.C. 154(b) by 153 days.

(21) Appl. No.: 13/475,184

(22) Filed: May 18, 2012

(65) Prior Publication Data

US 2013/0307256 A1 Nov. 21, 2013

(51) Int. Cl.
*A63C 11/00* (2006.01)
*A63C 11/10* (2006.01)

(52) U.S. Cl.
USPC ..... 280/809; 280/816; 411/382; 411/395

(58) Field of Classification Search
CPC ..... A63C 11/00; A63C 11/10; A63C 5/006
USPC ..... 280/809, 816; 411/382, 395
See application file for complete search history.

(56) References Cited

U.S. PATENT DOCUMENTS 3,771,410 A * 11/1973 Swindt, II ..... 411/338
4,267,615 A * 5/1981 Nealy ..... 441/75
4,863,326 A * 9/1989 Vickers ..... 411/105
4,981,735 A * 1/1991 Rickson ..... 428/36.9
5,137,483 A * 8/1992 Nealy ..... 441/75
5,609,434 A * 3/1997 Yehezkieli et al. ..... 403/260
6,688,931 B2 2/2004 Hart
7,147,399 B2 12/2006 Viscount et al.
7,836,734 B2 * 11/2010 Lynch ..... 70/58
2003/0224677 A1 12/2003 Hart
2004/0037635 A1 2/2004 Viscount et al.
2009/0115181 A1 5/2009 Atherton
2011/0198833 A1 8/2011 Shaheen

* cited by examiner

*Primary Examiner* — Hau Phan
*Assistant Examiner* — Bryan Evans
(74) *Attorney, Agent, or Firm* — Antoinette M. Tease

(57) ABSTRACT

An insert for a sports board comprising an outer ring unit comprising a threaded top piece and a threaded bottom piece and an inner insert unit comprising a threaded top piece and a threaded bottom piece. The outer ring unit is installed into a mounting hole that penetrates through a sports board. The top and bottom pieces of the outer ring unit each comprises a flange with a diameter greater than the diameter of the mounting hole. The top piece and the bottom piece of the outer ring unit are both hollow, thereby creating an insert hole for the inner insert unit when the top piece and bottom piece of the outer are screwed together. The top piece and the bottom piece of the inner insert unit are installed into the insert hole created by the top piece and bottom piece of the outer ring unit and screwed together.

12 Claims, 10 Drawing Sheets

INTERCHANGEABLE TWO-PIECE INSERT FOR SNOW SKI OR SNOWBOARD

BACKGROUND OF THE INVENTION

1. Field of the Invention

The present invention relates to the field of interchangeable personalized attachments that are fastened to sports equipment such as skis and snowboards for the purpose of ornamentation and identification.

2. Description of the Related Art

There are a number of attachment devices and means for attaching personalized accessories to sports equipment that are the subject of issued patents or patent pending applications, but none of these inventions includes the novel features of the present invention, most notably a two-piece threaded base component that is permanently attached to the sports equipment, in combination with a personalized and interchangeable insert component that can be temporarily locked into the base component via a two-piece threaded connection system.

U.S. Pat. No. 4,267,615 (Nealy, 1981) describes a device that serves as a connector between a leash and a surf mat. U.S. Pat. No. 5,137,483 (Nealy, 1992) is an improved version of the invention described in the '615 patent. Although Nealy discloses a two-piece threaded base configuration, the Nealy connectors do not comprise a permanent outer ring in combination with a removable inner insert component, nor is there a waterproof seal between the base component and the hole through the surf mat. U.S. Pat. No. 6,688,931 (Hart, 2004) provides a rotatable, "turret style" cover that can be used in combination with Nealy's connector described in the '483 patent.

U.S. Pat. No. 7,147,399 (Viscount et al., 2006) provides an apparatus for removably attaching ornaments to planar surfaces such as snowboards. U.S. Patent Application Pub. No. 2009/0115181 (Atherson) describes a removable ornament for mounting on a sporting board. Neither of these devices comprises a two-piece threaded base component that is mounted within a hole that penetrates both the upper and lower surfaces of the mounting surface (e.g., the snowboard).

U.S. Patent Application Pub. No. 2011/0198833 (Shaheen) discloses a removable ornament mounting system for a sports board that comprises a receptacle and a removable insert plug. Unlike the present invention, neither the base (receptacle) nor plug (insert) of the Shaheen invention is comprised of two threaded, lockable components.

BRIEF SUMMARY OF THE INVENTION

The present invention is an insert for a sports board comprising: an outer ring unit comprising a threaded top piece and a threaded bottom piece, wherein the outer ring unit is installed into a mounting hole that penetrates through a sports board having a top surface and a bottom surface, and wherein the mounting hole has a diameter: and an inner insert unit comprising a threaded top piece and a threaded bottom piece: wherein the top piece and the bottom piece of the outer ring unit each comprises a flange with a diameter greater than the diameter of the mounting hole; wherein when the top piece and the bottom piece of the outer ring unit are screwed together, the flange of the top piece presses downward onto the top surface of the sports board, and the flange of the bottom piece presses upward onto the bottom surface of the sports board; wherein the top piece and the bottom piece of the outer ring unit are both hollow, thereby creating an insert hole for the inner insert unit when the top piece and bottom piece of the outer are screwed together; and wherein the top piece and the bottom piece of the inner insert unit are installed into the insert hole created by the top piece and bottom piece of the Outer ring unit and screwed together.

In a preferred embodiment, the top piece of the inner insert unit comprises a horizontal through-hole for attachment of ornamental items. In an alternate embodiment, the top piece of the inner insert unit comprises a top surface and a rubber insert that extends through the top surface of the top insert piece, and the rubber insert comprises a horizontal pinhole for attachment of ornamental items. In the latter embodiment, the top piece of the inner insert unit comprises a hollow cavity with shoulders; the rubber insert is shaped to fit into the hollow cavity; the rubber insert comprises a first portion with an outer diameter, a second portion with an outer diameter, and shoulders above and below the first portion; the outer diameter of first portion is less than outer diameter of the second portion; and the shoulders of the rubber insert: mate with the shoulders of the hollow cavity.

In an alternate embodiment, the top piece of the inner insert unit comprises a logo button segment. In yet another alternate embodiment, the top piece of the inner insert unit comprises a top end and a bottom end; the top piece of the inner insert unit comprises a lanyard hole that extends from the top end of the top piece of the inner insert unit to the bottom end of the top piece of the inner insert unit; a lanyard passes through the lanyard hole: and the lanyard comprises a first end, a second end and a lanyard stop at both the first end and the second end of the lanyard.

In a preferred embodiment, the mounting hole is round; the threaded bottom piece of the outer ring unit comprises a barrel; the barrel is round; the barrel has an outer diameter; the mounting hole has an inner diameter; and the inner diameter of the mounting hole is slightly greater than the outer diameter of the barrel. Preferably, the bottom piece of the outer ring unit comprises a female threaded segment, and the top piece of the outer ring unit comprises a male threaded segment. Preferably, the bottom piece of the inner insert unit comprises a female threaded segment, and the top piece of the inner insert unit comprises a male threaded segment.

In a preferred embodiment, the top piece of the outer ring unit and the bottom piece of the outer ring unit each comprises a beveled face; the top piece of the inner unit and the bottom piece of the inner insert unit each comprises a flange; the flange of the top piece of the inner insert unit comprises a lower surface, and the flange of the bottom piece of the inner insert unit comprises an upper surface; and when the top piece of the inner insert unit and the bottom piece of the inner insert unit are fully tightened together, the lower surface of the flange of the top piece of the inner insert unit is in contact with beveled face of the top portion of the outer ring unit, and the upper surface of the flange of the bottom piece of the inner insert unit is in contact with the beveled face of the bottom piece of the outer ring unit.

In a preferred embodiment, the top piece of the outer ring unit and the bottom piece of the outer ring unit each comprises concentric indentations that fit into a wrench. The bottom piece of the inner insert unit preferably comprises a hex socket.

REFERENCE NUMBERS

Figure 1:
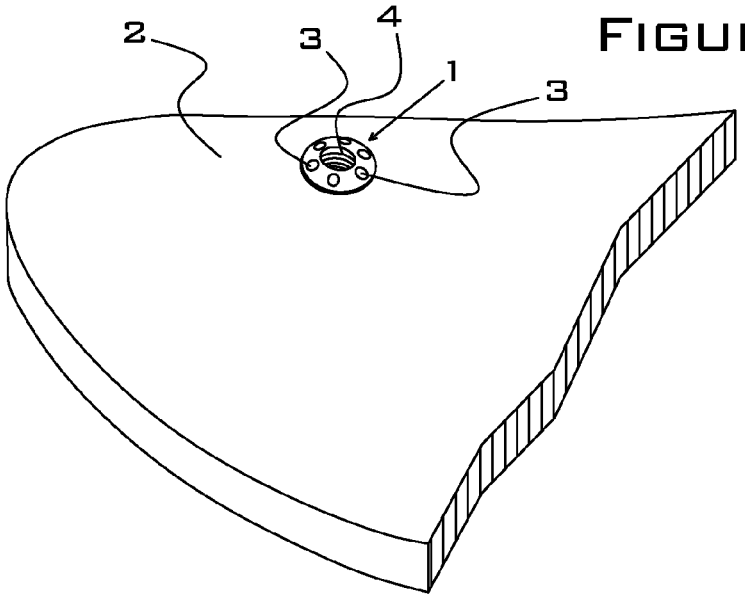
FIG. 1 is a perspective view of the ring unit of the present invention installed in the tip of a snow ski.

1 Top piece of ring unit
2 Board
3 Indentation
4 Insert hole
5 Top piece of inner insert unit, first embodiment
6 Jewelry, first embodiment
7 Wire hook component of earring
8 Attachment hole
9 Wire stop
10 Bottom piece of ring unit
11 Bottom piece of inner insert unit
12 Top insert flange
13 Threaded segment of top piece of inner insert unit
14 Top ring flange
15 Threaded segment of top piece of ring unit
16 Beveled shoulder
17 Threaded segment of bottom ring piece
18 Barrel of bottom ring piece
19 Bottom ring flange
20 Threaded segment of bottom piece of inner insert
21 Bottom insert flange
22 Hex socket
23 Top piece of insert, unit, second embodiment
24 Hollow cavity
25 Shoulders in hollow cavity of top piece of insert unit, second embodiment
26 Rubber insert
27 Pinhole
28 First portion of rubber insert
29 Second portion of rubber insert
30 Shoulders of rubber insert
31 Top piece of insert unit, third embodiment
32 Logo button segment
33 Top piece of insert unit, fourth embodiment
34 Lanyard hole
35 Decorative attachment
36 Beads
37 Lanyard
38 First lanyard stop
39 Second lanyard stop

DETAILED DESCRIPTION OF INVENTION

The present invention is a connection device that provides for personalized items such as jewelry or identification logos to be securely but removably attached to sports equipment such as a snow ski or a snow board (hereafter generically referred to as a "board"). The invention comprises an outer ring unit and an inner insert unit. The ring unit is comprised of a hollow top piece with male threads and a hollow bottom piece with matching female threads. The ring unit is installed into a predrilled mounting hole that penetrates through the board. The mounting hole is preferably round for ease of manufacture and to preserve the integrity of the ski or snowboard.

The top piece of the ring unit is inserted into the hole through the top side of the board, and the bottom piece of the ring unit is inserted into the hole through the bottom side of the board. The top and bottom pieces are then screwed together. Both pieces have a flange at their outside edge, with the diameter of the flanges being larger than the diameter of the drilled hole. When the top and bottom pieces are screwed together, the flange of the top piece presses downward onto the top surface of the board, while the flange of the bottom piece simultaneously presses upward onto the bottom surface of the board. Because the top and bottom flanges are larger than the diameter of the mounting hole, the assembled ring unit is prevented from sliding out of the hole from either the top or bottom side of the board.

The top and bottom pieces of the ring unit are both hollow, thus creating a hole through the center of the ring unit (referred to herein as the "insert hole") from top to bottom after the unit is installed. Thread locking compound is preferably applied to the threads of each ring piece prior to assembly to prevent inadvertent separation of the top and bottom pieces when the board is subjected to rough physical activity and also to the threads of each insert piece. Waterproof sealant is preferably applied to the edge of the mounting hole prior to installation of the ring unit to prevent water from seeping into the interior region of the board. Each of the ring pieces comprises concentric indentations that fit into special wrenches, which allow the threads of the two pieces to be easily yet securely tightened.

The inner insert unit is also comprised of a threaded top piece and a threaded bottom piece. These two pieces are assembled by inserting the top insert piece into the top side of the insert hole in the ring, inserting the bottom insert piece into the bottom side of the insert hole, and then screwing the threads of the top insert piece into the threads of the bottom insert piece. The bottom insert piece comprises a hex socket, which allows the top and bottom insert pieces to be easily assembled and disassembled by the owner with a standard hex wrench. Each of the two insert pieces has a flange on the outside edge, and these flanges prevent the insert unit from slipping out of the insert hole when the two insert pieces are connected.

In general, the outer ring, piece is designed to be permanently installed on a board by a ski shop or by the owner, while the inner insert unit is designed to be interchanged by the user, so that the display jewelry or other personal artifact that is attached to the insert unit may be easily removed and replaced with a new item by the owner.

In a first embodiment of the present invention, the top insert piece comprises a horizontal through-hole for the purpose of attaching a piece of jewelry such as an earring designed for pierced ears. In this embodiment, the top surface of the top insert piece may optionally be engraved or coated with a decorative design. In a second embodiment of the present invention, the top insert piece comprises a rubber insert that extends through the top surface of the top insert piece, and the rubber insert comprises a horizontal pinhole for the purpose of attaching jewelry such as an earring designed for pierced ears.

In a third embodiment of the present invention, the top insert piece is fitted with a logo button similar to a hat pin, for example, a button bearing the logo of a particular ski resort. In a fourth embodiment of the present invention, the top insert piece comprises a short, woven-wire lanyard that extends through the top of the insert piece, for the purpose of attaching a personalized string of decorative beads. Each of these embodiments is discussed more fully below with reference to the figures.

FIG. 1 is a perspective view of the outer ring portion of the present invention mounted in a typical application. As shown in the FIG. 1, the top piece of the ring unit 1 protrudes slightly above the top surface of a board 2 when the ring portion of the invention is attached to the board 2. Six concentric indentations 3 are machined into the top surface of the top piece of the ring unit 1. An insert hole 4 passes through the ring unit from top to bottom. The six concentric indentations 3 are used in conjunction with a special wrench (not shown) to attach the invention to a board.

Figure 2:
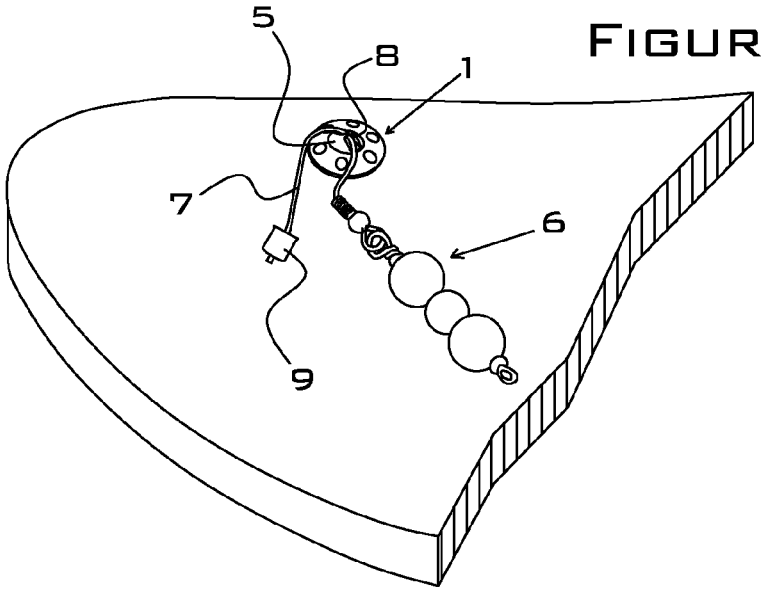
FIG. 2 is a perspective view of the first embodiment of the present invention installed in the tip of a board.

FIG. 2 is a perspective view of the first embodiment of the present invention mounted in a typical application. This figure shows the top piece of the ring unit 1, the top piece of the insert unit 5, and a piece of decorative jewelry 6. The jewelry 6 shown in this figure is an earring made for pieced ears. It comprises a wire hook 7 that passes through an attachment hole 8 in the top piece of the inner insert unit 5. A wire stop 9 keeps the jewelry 6 from slipping out of the attachment hole 8 in the top piece of the inner insert 5.

Figure 3:
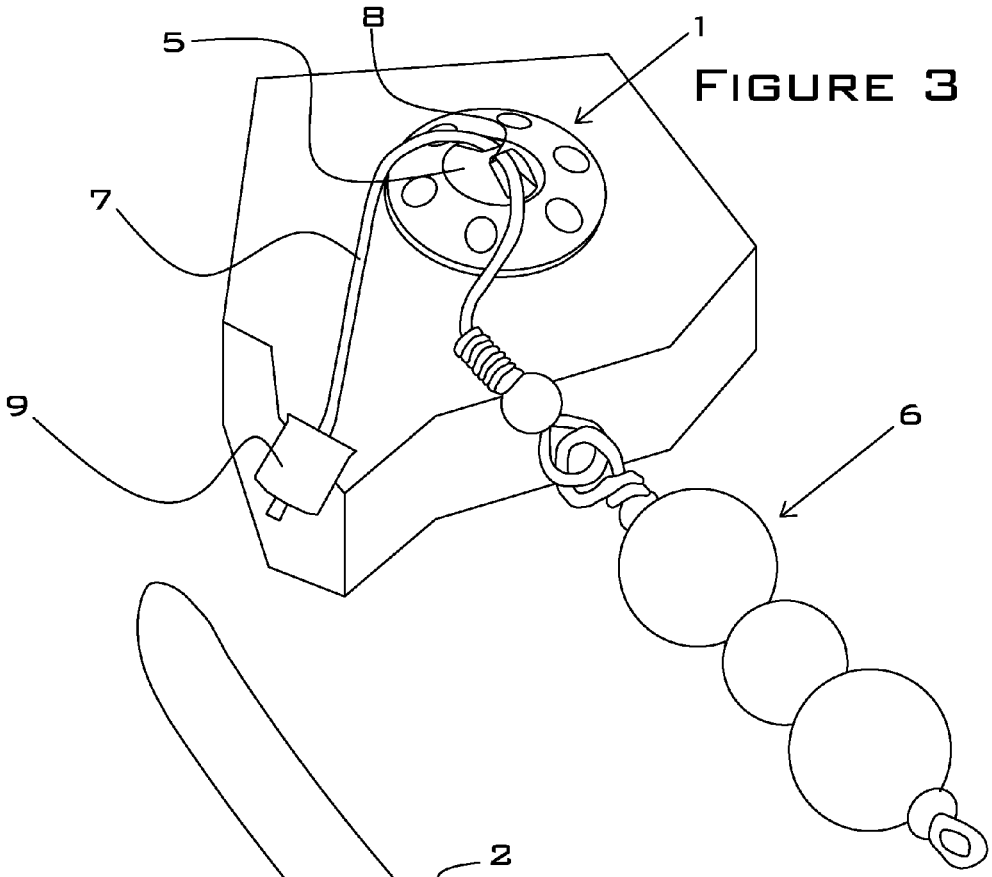
FIG. 3 is a magnified detail of the invention shown in FIG. 2.

FIG. 3 is a magnified detail view of FIG. 2, more clearly showing the wire hook 7 passing through the attachment hole 8 that is manufactured into the top piece of the inner insert unit 5.

Figure 4:
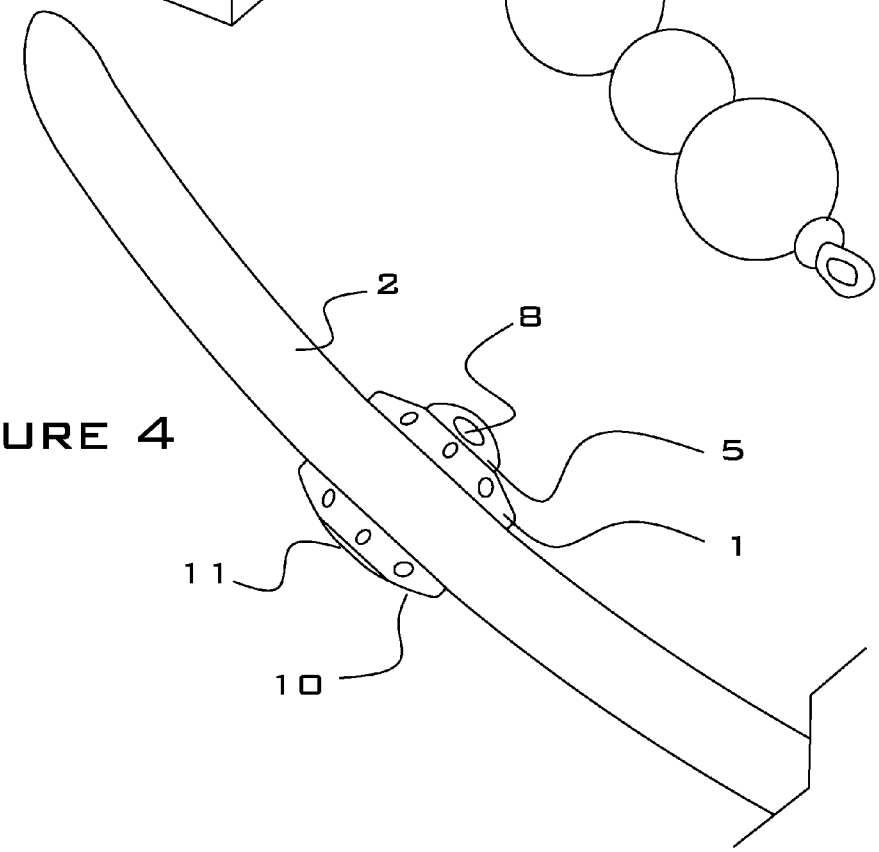
FIG. 4 is a side view of the first embodiment of the present invention installed in a board, with the personal jewelry omitted for clarity.

FIG. 4 is a side view of the first embodiment of the present invention (shown without jewelry attachments for clarity) mounted near the tip of a board 2. This figure illustrates the low profile of the invention and the rounded outer edges that prevent the invention from catching on another board or on snow. Shown in FIG. 4 are the top piece of the inner insert unit 5 with integral attachment hole 8, top piece of the ring unit 1, bottom piece of the ring unit 10, and bottom piece of the insert unit 11.

Figure 5:
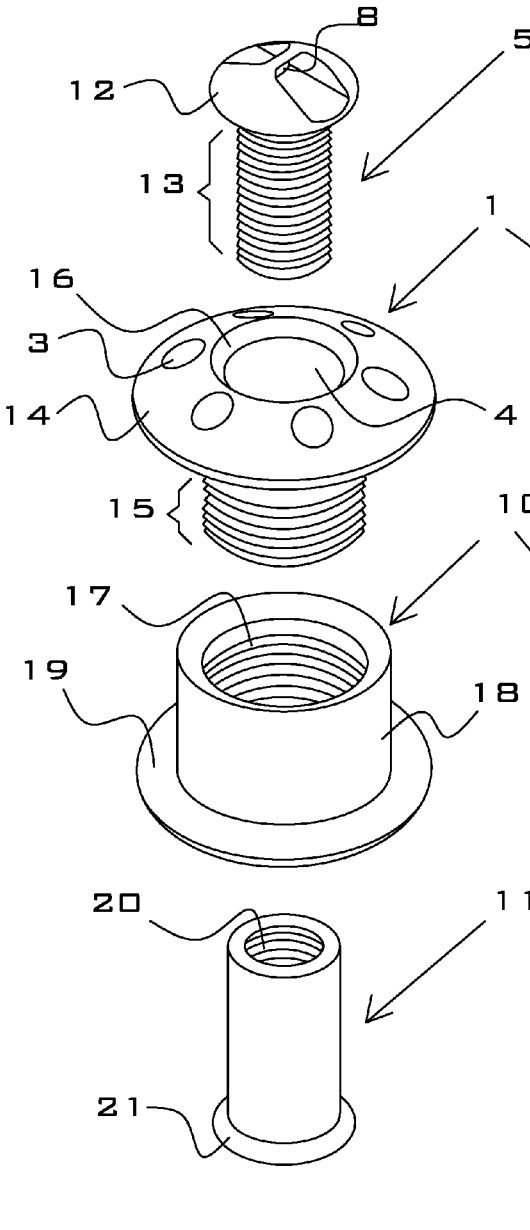
FIG. 5 is an exploded perspective view of the first embodiment of the present invention.
Figure 6:
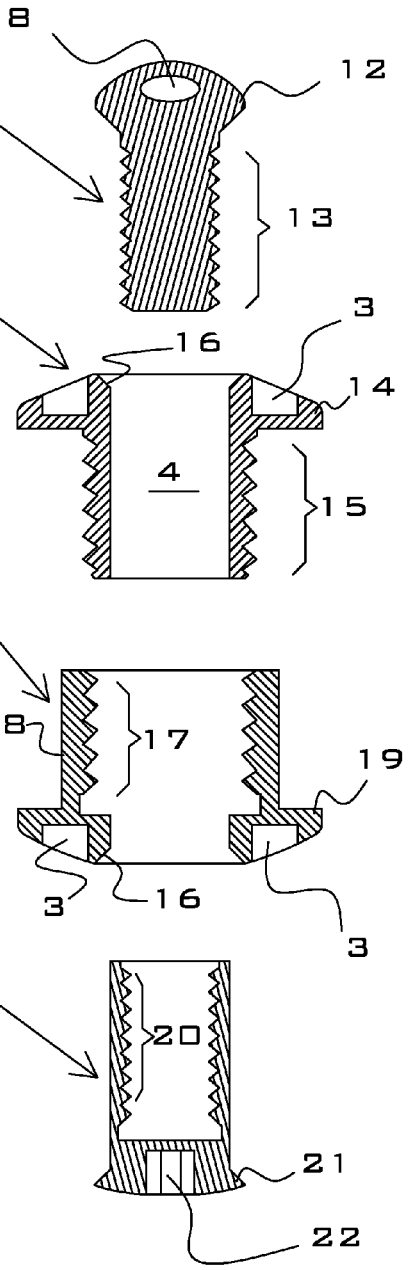
FIG. 6 is an exploded cross-section side view of the first embodiment of the present invention.

FIG. 5 is an exploded perspective view and FIG. 6 is an exploded cross-section side view of the first embodiment of the present invention. Primary components include the top piece of the insert unit 5, the top piece of the ring unit 1, the bottom piece of the ring unit 10 and the bottom piece of the insert unit 11. As shown in FIGS. 5 and 6, the top piece of the insert unit 5 comprises an attachment hole 8, a top insert flange 12, and a threaded segment 13 with male threads. The top piece of the ring unit 1 comprises a top ring flange 14, concentric indentations 3, an insert hole 4, a threaded segment 1 with male threads, and a beveled shoulder 16. The bottom piece of the ring unit 10 comprises a threaded segment 17 of female threads, an outer barrel 18, a bottom ring flange 19, concentric indentations 3, and a beveled shoulder 16. The bottom piece of the insert unit 11 comprises a threaded segment 20 with female threads, a bottom insert flange 21 and a hex socket 22.

The present invention is installed and assembled as follows: A hole is drilled into a board that penetrates the board from top to bottom, with the hole having a slightly larger diameter than the diameter of the barrel 18 of the bottom ring piece 10. The top piece of the ring unit 1 is inserted into the drilled hole through the top side of the board, and the bottom piece of the ring unit 10 is inserted into the drilled hole from the bottom of the board. The male threaded segment 15 of the top of the ring unit 5 is screwed into the female threaded segment 17 of the bottom piece of the ring unit 10 so that the lower face of the top ring flange 14 is drawn tight against the upper surface of the board, and the upper face of the bottom ring flange 19 is drawn up tight against the bottom side of the board. The concentric indentations 3 on the top rime piece 1 and on the bottom ring piece 10 fit special wrenches that are used to tighten the threaded connection of the top ring piece 1 and the bottom ring piece 10.

To install the insert components into the ring unit, the top insert piece 5 is inserted into the top side of the insert hole 4, and the bottom insert piece 11 is inserted into the bottom side of the insert hole 4. The male threaded segment 13 of the top insert piece 5 is then screwed into the female threaded segment 20 of the bottom insert piece 11. The hex socket 22 of the bottom inner insert piece 11 accepts a standard hex wrench, which is used to fully tighten together the threads 13, 20 of the top insert piece 5 and the bottom insert piece 11. When the top and bottom insert pieces 5 and 11 are fully tightened together, the lower surface of the top insert flange 12 is in contact with the beveled face 16 of the top ring piece 1, and the upper surface of the bottom insert flange 21 is in contact with the beveled face 16 of the bottom ring piece 10. The relationship of the assembled pieces is shown in FIG. 8.

Figure 7:
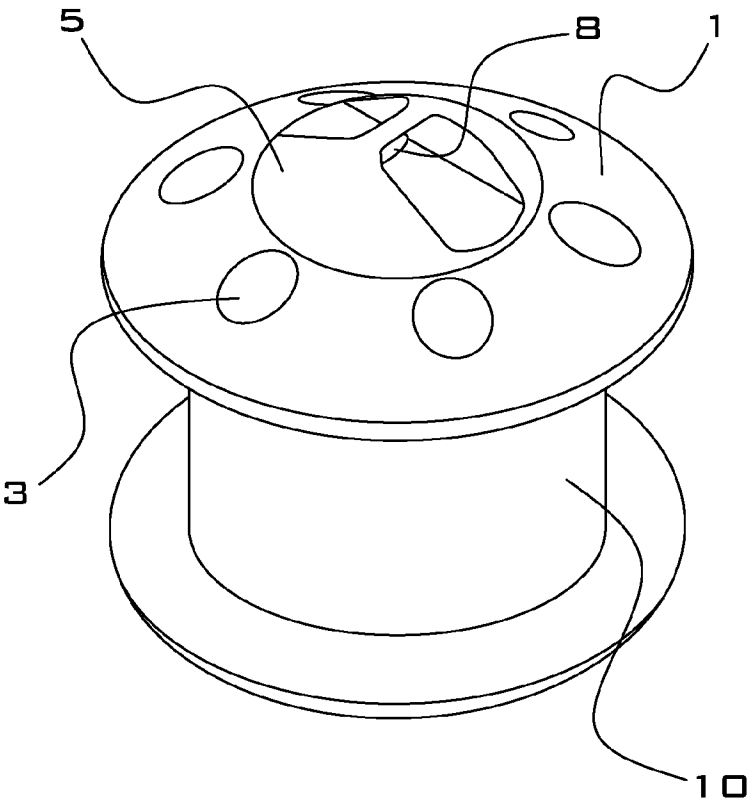
FIG. 7 is a perspective view of the first embodiment of the present invention with the components assembled.

FIG. 7 is a perspective view of the first embodiment of the present invention, shown assembled, with the jewelry attachment omitted for clarity. This figure shows the top piece of the ring unit 1 with concentric indentations 3, the top piece of the inner insert 5 with the integral attachment hole 8, and the bottom piece of the rinse unit 10.

Figure 8:
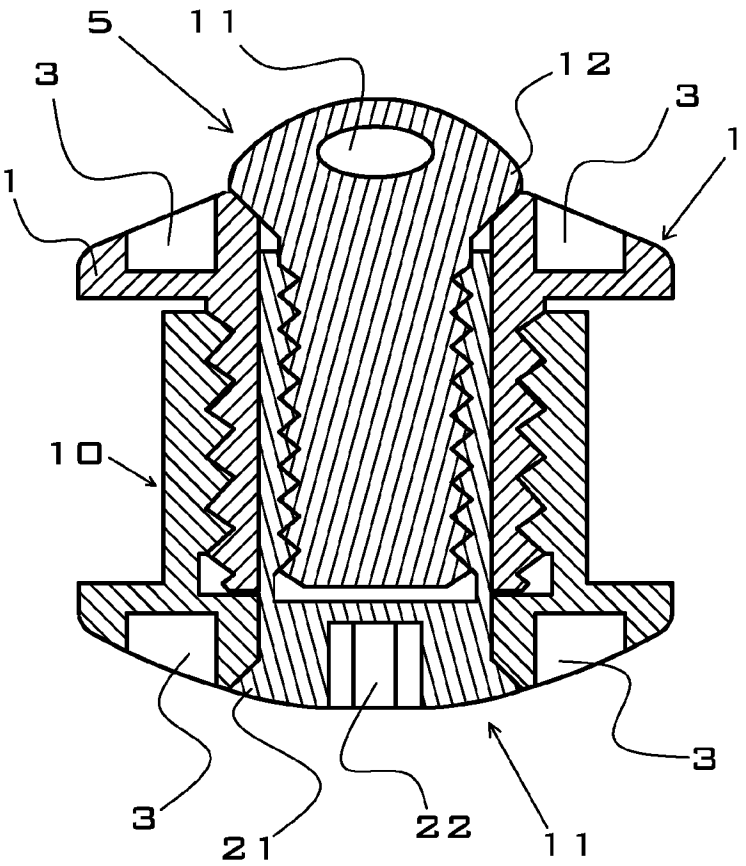
FIG. 8 is a cross-section side view of the first embodiment of the present invention with the components assembled.

FIG. 8 is a cross-section side view of the first embodiment of the present invention, also shown without the jewelry attachment for clarity. This figure shows the relationship of the threaded parts when the invention is in the assembled state. As previously described, the top piece of the ring unit 1 is threaded into the bottom piece of the ring unit 10, and the top piece of the inner insert 5 is threaded into the bottom piece of the inner insert 11. This figure also illustrates that the top insert flange 12 of the top piece of the insert unit 5 and the bottom insert flange 21 of the bottom piece of the inner insert unit 10 are larger in diameter than the diameter of the insert hole 4 (shown in FIGS. 5 and 6); therefore, the flanges 12 and 21 prevent the top piece of the insert unit 5 and the bottom piece of the insert unit 11 from slipping out of the insert hole 4 when these two insert pieces are threaded together.

Figure 9:
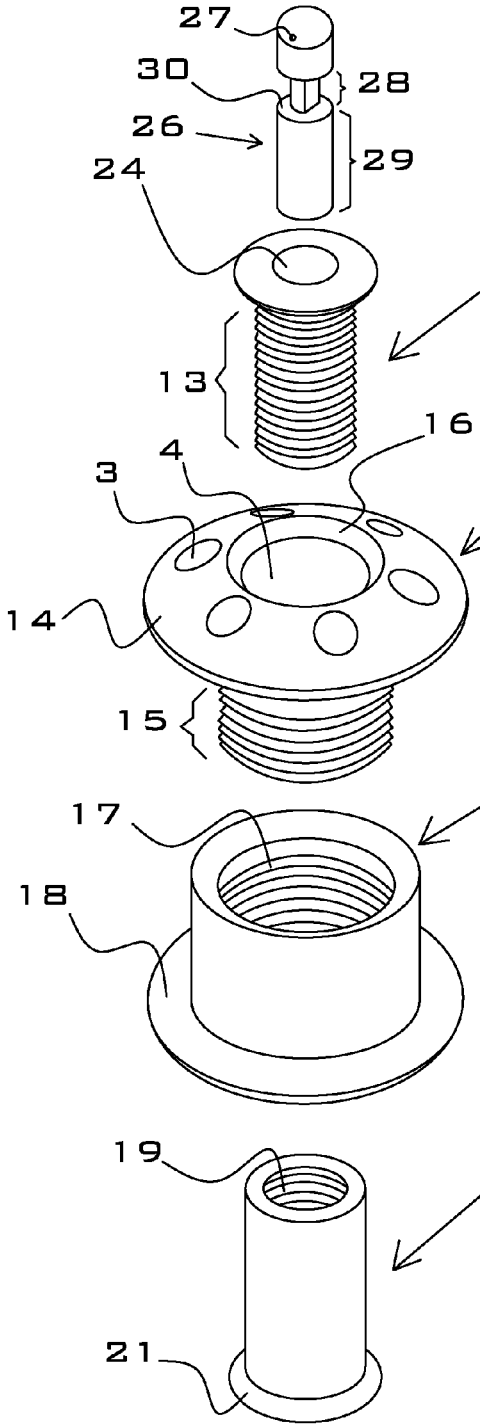
FIG. 9 is an exploded perspective view of the second embodiment of the present invention.
Figure 10:
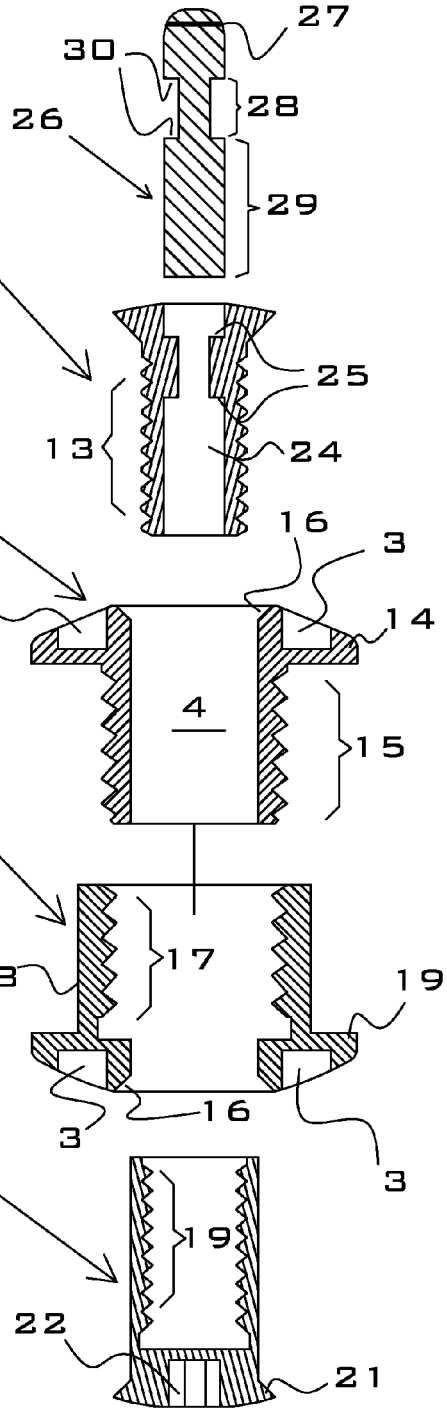
FIG. 10 is an exploded cross-section side view of the second embodiment of the present invention.

FIG. 9 is an exploded perspective view and FIG. 10 is an exploded cross-section side view of the second embodiment of the present invention, which comprises a rubber insert piece for the attachment of jewelry or similar artifacts. In the second embodiment, most of the parts (namely, the top piece of the ring unit 1, the bottom piece of the ring unit 10, and the bottom piece of the inner insert unit 11) are identical to those of the first embodiment; however, one piece (namely, the top piece of the inner insert unit 23) is different than the top piece of the inner insert unit 5 of the first embodiment.

As shown in FIGS. 9 and 10, the top piece of the insert unit 23 of the second embodiment comprises a hollow cavity 24 with shoulders 25, a threaded segment 13, and a rubber insert 26, with the rubber insert 26 shaped to fit into the hollow cavity 24 of the top piece of the inner insert 23. The rubber insert 26 is rounded on top and comprises a horizontal pinhole 27. The pinhole 27 accepts jewelry such as earrings designed for pierced ears (not shown). As shown in FIGS. 9 and 10, the outer surface of the rubber insert 26 is generally cylindrical, with a first portion 28, a second portion 29, and shoulders 30 above and below the first portion 28. This specialized shape, in which the outer diameter of the first portion 28 is less than the outer diameter of the second portion 29, fits snugly into the hollow cavity 24 of the top piece of the insert 23, and the shoulders 30 of the rubber insert 26 mate with the shoulders 25 of the hollow cavity 24 to prevent the rubber insert 26 from inadvertently escaping from the hollow cavity 24.

Figure 11:
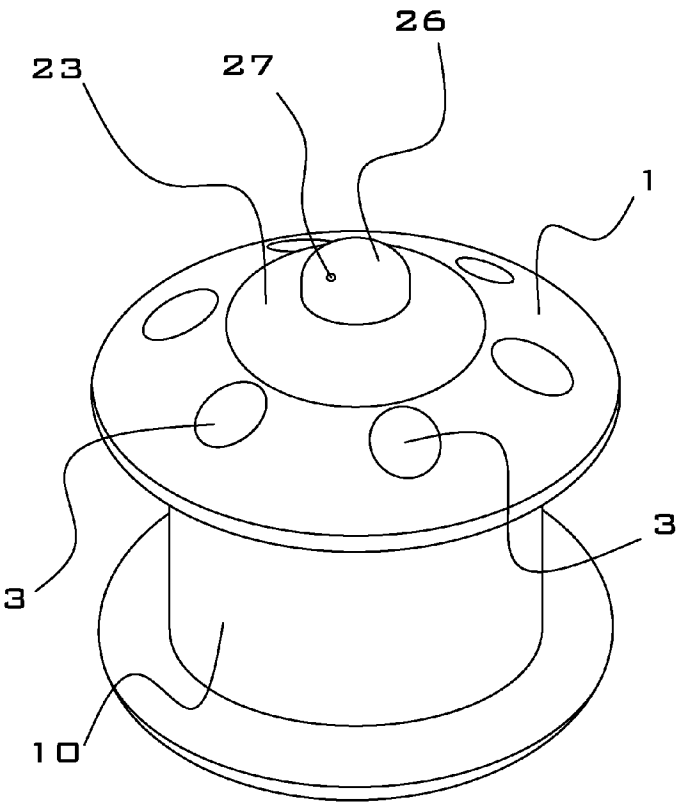
FIG. 11 is a perspective view of the second embodiment of the present invention with the components assembled.

FIG. 11 is a perspective view of the second embodiment of the present invention, shown assembled. This figure shows the top piece of the ring unit 1 with concentric indentations 3, the top piece of the insert 23 of the second embodiment, the rubber insert 26 with an integral pinhole 27, and the bottom piece of the ring unit 10.

Figure 12:
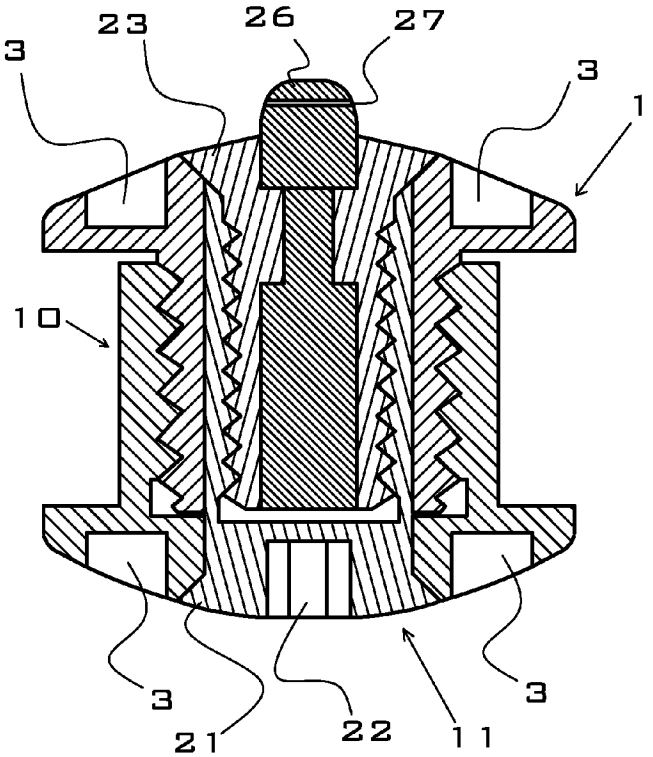
FIG. 12 is a cross-section side view of the second embodiment of the present invention with the components assembled.

FIG. 12 is a cross-section side view of the second embodiment of the present invention, showing the relationship of the parts when the invention is assembled. As shown, the top rounded portion of the rubber insert 26 protrudes above the top surface of the top piece of the insert unit 23, thereby allowing access to the pinhole 27 for the purpose of attaching an earring or similar artifact. The second embodiment of the present invention is assembled similarly to the procedure previously described for the first embodiment, except that for the second embodiment, the rubber insert 26 is installed within the hollow cavity 24 of the top piece of the insert unit 23 as shown in FIGS. 11 and 12.

Figure 13:
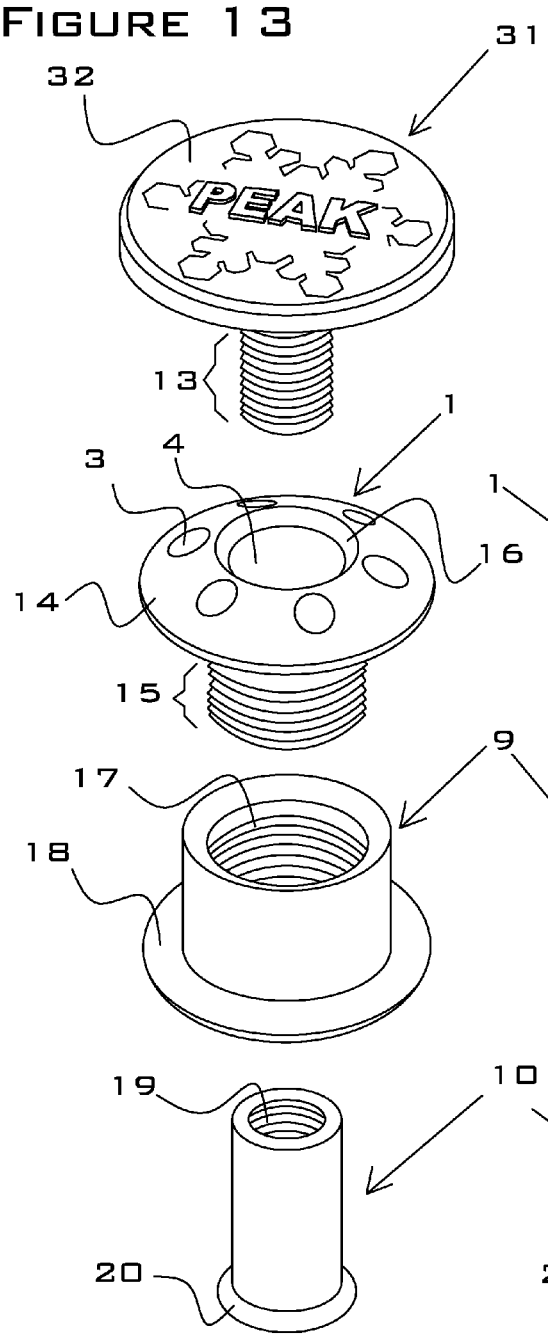
FIG. 13 is an exploded perspective view of the third embodiment of the present invention.
Figure 14:
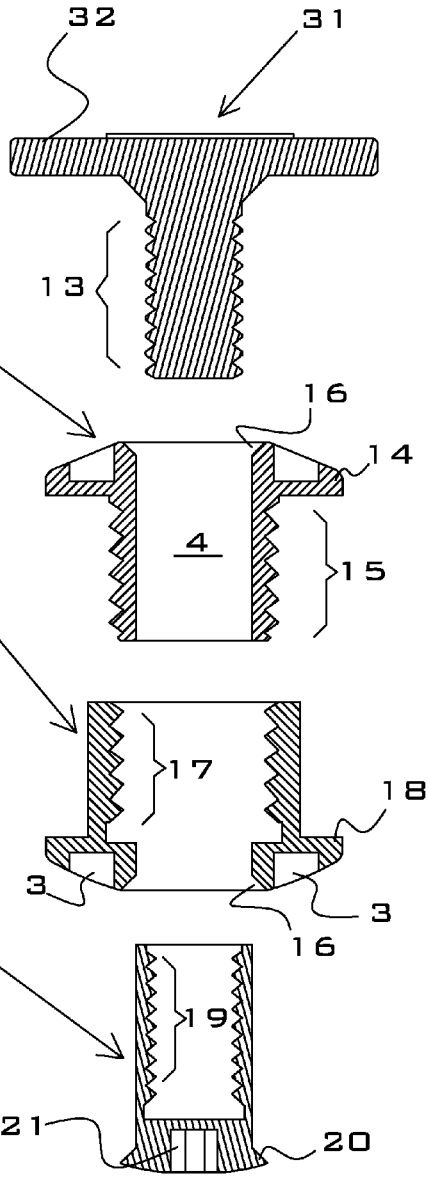
FIG. 14 is an exploded cross-section side view of the third embodiment of the present invention.

FIG. 13 is an exploded perspective view and FIG. 14 is an exploded cross-section side view of the third embodiment of the present invention, which incorporates a logo button. As an example, the button shown is a logo for the fictitious Peak Ski Resort, but any logo or other design could be manufactured onto the logo button segment. In the third embodiment, most of the parts (namely, the top piece of the ring unit 1, the bottom piece of the ring unit 10, and the bottom piece of the inner insert unit 11) are identical to those of the first embodiment; however, one piece (namely, the top piece of the inner) insert unit 31) is different than the top piece of the inner insert unit 5 of the first embodiment.

As shown in FIGS. 13 and 14, the top piece 31 of the third embodiment comprises a logo button segment 32 and a threaded segment 13. The third embodiment is assembled in a similar fashion to that previously described for the first embodiment, wherein the op ring piece 1 and the bottom ring piece 10 are inserted into a predrilled hole and screwed together, and then the top insert piece 31 and the bottom insert piece 11 are inserted into the insert hole 4 and screwed together.

Figure 16:
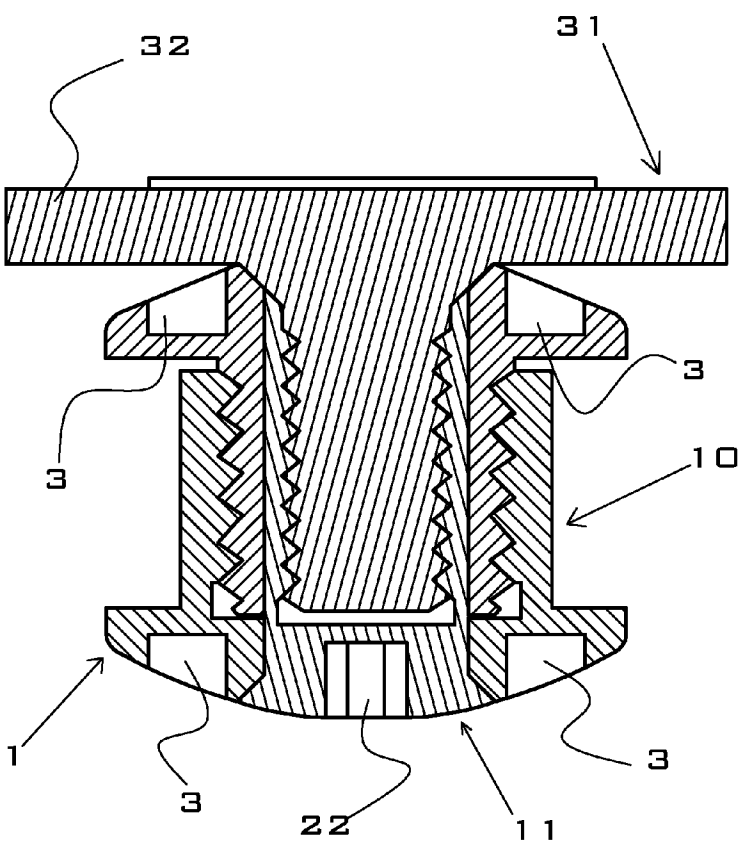
FIG. 16 is a cross-section side view of the third embodiment of the present invention with the components assembled.
Figure 15:
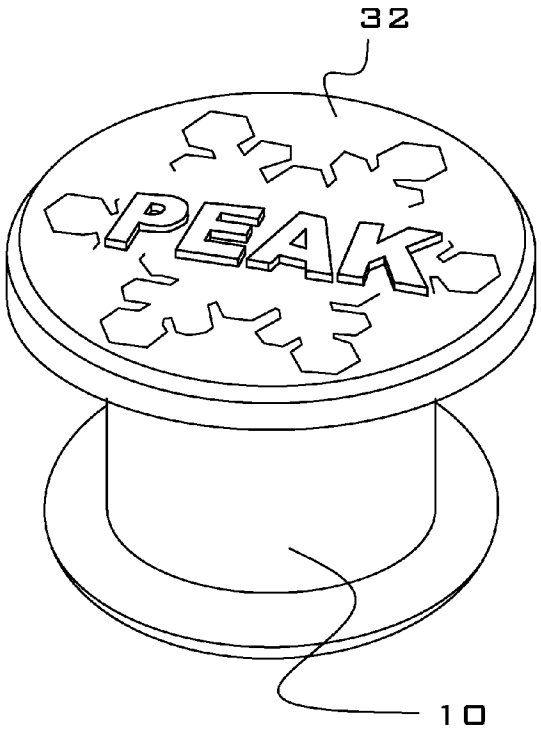
FIG. 15 is a perspective view of the third embodiment of the present invention with the components assembled.

FIG. 15 is perspective view of the third embodiment of the present invention, shown assembled. This figure shows the logo button segment 32 and the bottom piece of the ring, unit 10. FIG. 16 is a cross-section side view of the third embodiment of the present invention showing the relationship of the parts when the invention is assembled.

Figures 17, 18:
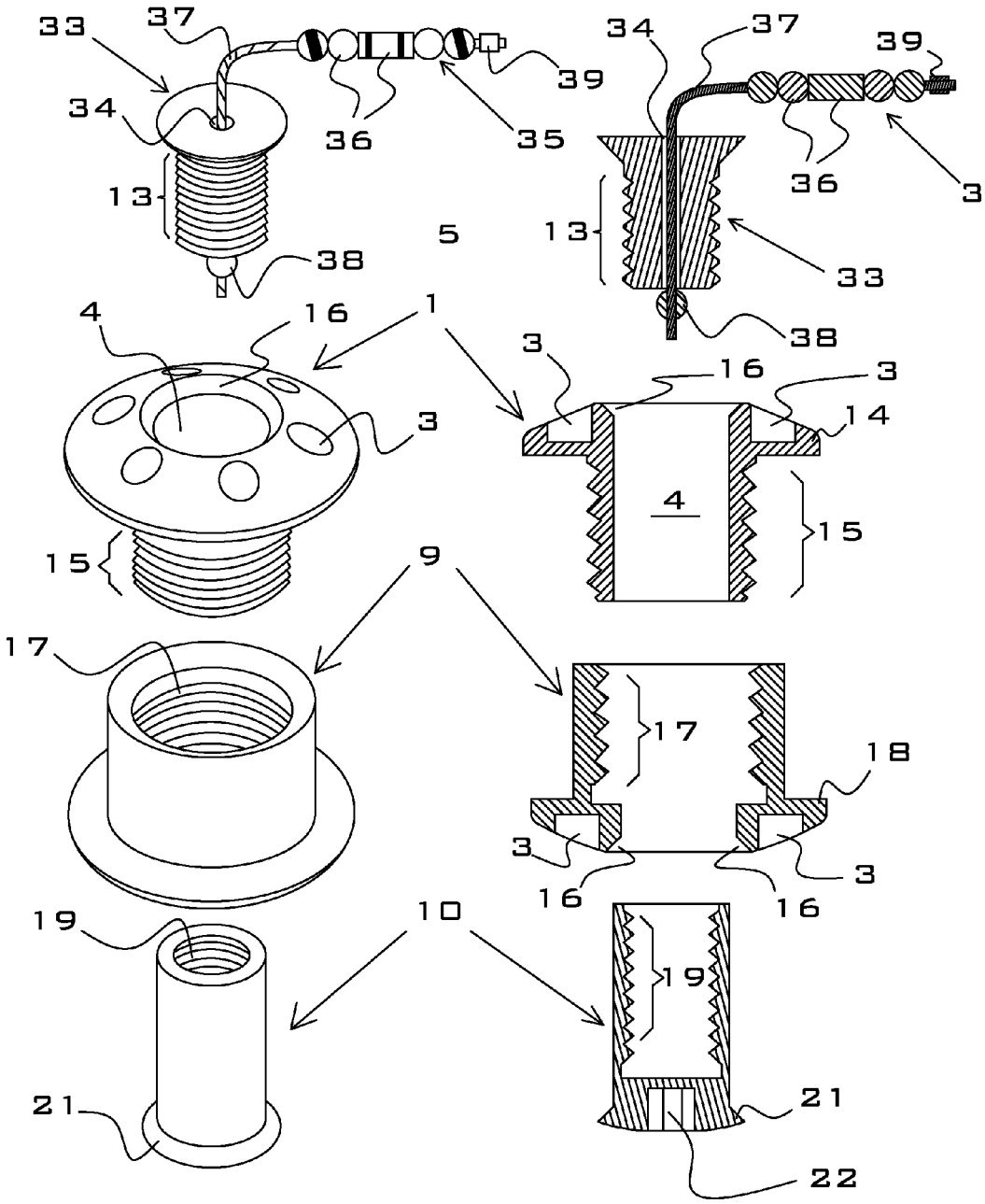
FIG. 17 is an exploded perspective view of the fourth embodiment of the present invention.
FIG. 18 is an exploded cross-section side view of the fourth embodiment of the present invention.

FIG. 17 is an exploded perspective view and FIG. 18 is an exploded cross-section side view of the fourth embodiment of the present invention, which comprises a removable lanyard with a personalized jewelry attachment. In the fourth embodiment, most of the parts (namely, the top piece of the ring unit 1, the bottom piece of the ring unit 10, and the bottom piece of the inner insert unit 11) are identical to those of the first embodiment; however, one piece (namely, the top piece of the inner insert unit 33) is different than the top piece of the inner insert unit 5 of the first embodiment.

As shown in FIGS. 17 and 18, the top piece of the insert 33 of the fourth embodiment comprises a lanyard hole 34, a threaded segment 13, and a decorative attachment 35. The decorative attachment 35 comprises one or more beads 36 or similar decorative ornaments, a lanyard 37, a first lanyard stop 38 and a second lanyard stop 39. The lanyard hole 34 has a diameter slightly larger than the diameter of the lanyard 37 so that the lanyard 37 passes through the top piece of the insert unit 33 from top to bottom, as shown in the figures. The first lanyard stop 38, which is located at the lower end of the lanyard 37, has an outer diameter larger than the diameter of the lanyard hole 34. The purpose of the first lanyard stop 38 is to prevent the lanyard from pulling out of the lanyard hole 34 in the upward direction.

The first lanyard stop 38 may be a comprised of a crimped-on split shot or may simply be a knot tied in the lower end of the lanyard 37. The beads 36 have through-holes slightly larger in diameter than the diameter of the lanyard 37 so that the beads 36 may be strung onto the lanyard 37, as shown in the figures. A second lanyard stop 39 is installed on the upper end of the lanyard. The second lanyard stop 39 has an outer diameter larger than the diameter of the through holes in the beads 37. The purpose of the second lanyard stop 39 is to prevent the beads from slipping off the upper end of the lanyard 7. The second lanyard stop 39 may be comprised of a crimped-on split shot or may simply be a knot tied in the upper end of the lanyard 37.

Figures 19, 20:
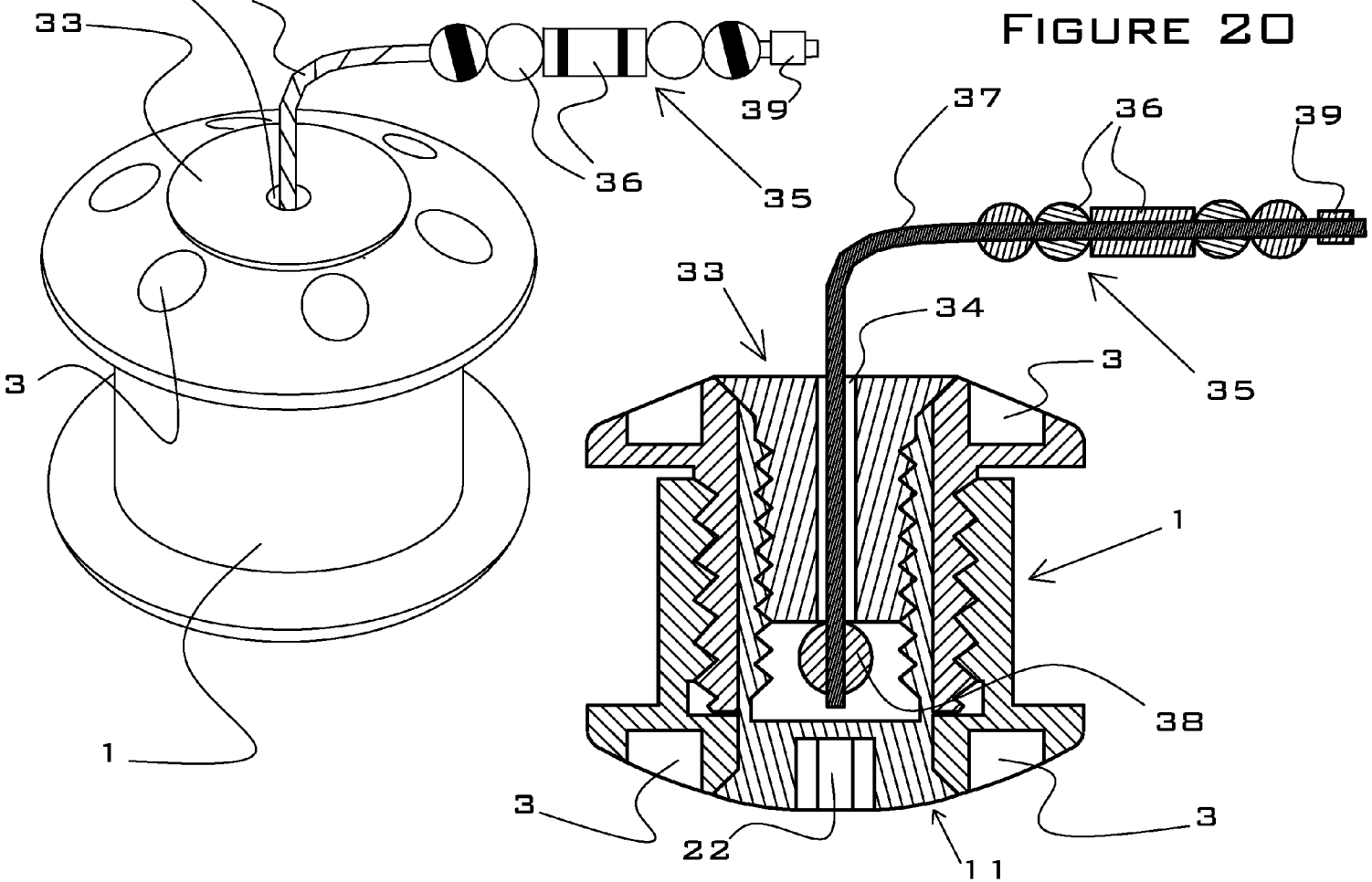
FIG. 19 is a perspective view of the fourth embodiment of the present invention with the components assembled.
FIG. 20 is a cross-section side view of the fourth embodiment of the present invention with the components assembled.

FIG. 19 is a perspective view of the fourth embodiment of the present invention, shown assembled. This figure shows the top piece of the insert unit 33, which comprises a lanyard hole 34 and decorative attachment 35. The decorative attachment 35 comprises beads 36, a lanyard 37, and a second lanyard stop 39. Also shown is the top piece of the ring unit 1 with integral concentric holes 3. FIG. 20 is a cross-section side view of the fourth embodiment of the present invention showing the relationship of the parts when the invention is assembled.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. An insert for a sports board comprising:

(a) an outer ring unit comprising a threaded top piece and a threaded bottom piece, wherein the outer ring unit is installed into a mounting hole that penetrates through a sports board having a top surface and a bottom surface, and wherein the mounting hole has a diameter; and (b) an inner insert unit comprising a threaded top piece and a threaded bottom piece having a non-threaded outer surface;

wherein the top piece and the bottom piece of the outer ring unit each comprises a flange with a diameter greater than the diameter of the mounting hole;

wherein when the top piece and the bottom piece of the outer ring unit are screwed together, the flange of the top piece presses downward onto the top surface of the sports board, and the flange of the bottom piece presses upward onto the bottom surface of the sports board;

wherein the top piece and the bottom piece of the outer ring unit are both hollow, thereby creating an insert hole with a non-threaded surface for the inner insert unit when the top piece and bottom piece of the outer ring unit are screwed together; and wherein the top piece and the bottom piece of the inner insert unit are installed into the insert hole created by the top piece and bottom piece of the outer ring unit and screwed together.

2. The sports board insert of claim 1, wherein the top piece of the inner insert unit comprises a horizontal through-hole for attachment of ornamental items.

3. The sports board insert of claim 1, wherein the top piece of the inner insert unit comprises a top surface and a rubber insert that extends through the top surface of the top insert piece; and wherein the rubber insert comprises a horizontal pinhole for attachment of ornamental items.

4. An insert for a sports board comprising:

(a) an outer ring unit comprising a threaded top piece and a threaded bottom piece, wherein the outer ring unit is installed into a mounting hole that penetrates through a sports board having a top surface and a bottom surface, and wherein the mounting hole has a diameter; and (b) an inner insert unit comprising a threaded top piece and a threaded bottom piece;

wherein the top piece and the bottom piece of the outer ring unit each comprises a flange with a diameter greater than the diameter of the mounting hole;

wherein when the top piece and the bottom piece of the outer ring unit are screwed together, the flange of the top piece presses downward onto the top surface of the sports board, and the flange of the bottom piece presses upward onto the bottom surface of the sports board;

wherein the top piece and the bottom piece of the outer ring unit are both hollow, thereby creating an insert hole for the inner insert unit when the top piece and bottom piece of the outer are screwed together;

wherein the top piece and the bottom piece of the inner insert unit are installed into the insert hole created by the top piece and bottom piece of the outer ring unit and screwed together;

wherein the top piece and the inner insert unit comprises a top surface and a rubber insert that extends through the top surface of the top insert piece; and wherein the rubber insert comprises a horizontal pinhole for attachment of ornamental items; and wherein the top piece of the inner insert unit comprises a hollow cavity with shoulders; wherein the rubber insert is shaped to fit into the hollow cavity; wherein the rubber insert comprises a first portion with an outer diameter, a second portion with an outer diameter, and shoulders above and below the first portion; wherein the outer diameter of first portion is less than outer diameter of the second portion; and wherein the shoulders of the rubber insert mate with the shoulders of the hollow cavity.

5. The sports board insert of claim 1, wherein the top piece of the inner insert unit comprises a logo button segment.

6. The sports board insert of claim 1, wherein the top piece of the inner insert unit comprises a top end and a bottom end; wherein the top piece of the inner insert unit comprises a lanyard hole that extends from the top end of the top piece of the inner insert unit to the bottom end of the top piece of the inner insert unit; wherein a lanyard passes through the lanyard hole; and wherein the lanyard comprises a first end, a second end and a lanyard stop at both the first end and the second end of the lanyard.

7. The sports board insert of claim 1, wherein the mounting hole is round; wherein the threaded bottom piece of the outer ring unit comprises a barrel; wherein the barrel is round; wherein the barrel has an outer diameter; wherein the mounting hole has an inner diameter; and wherein the inner diameter of the mounting hole is slightly greater than the outer diameter of the barrel.

8. The sports board insert of claim 1, wherein the bottom piece of the outer ring unit comprises a female threaded segment, and the top piece of the outer ring unit comprises a male threaded segment.

9. The sports board insert of claim 1, wherein the bottom piece of the inner insert unit comprises a female threaded segment, and the top piece of the inner insert unit comprises a male threaded segment.

10. The sports board of claim 1, wherein the top piece of the outer ring unit and the bottom piece of the outer ring unit each comprises a beveled face; wherein the top piece of the inner unit and the bottom piece of the inner insert unit each comprises a flange; wherein the flange of the top piece of the inner insert unit comprises a lower surface, and the flange of the bottom piece of the inner insert unit comprises an upper surface; and wherein when the top piece of the inner insert unit and the bottom piece of the inner insert unit are fully tightened together, the lower surface of the flange of the top piece of the inner insert unit is in contact with beveled face of the top portion of the outer ring unit, and the upper surface of the flange of the bottom piece of the inner insert unit is in contact with the beveled face of the bottom piece of the outer ring unit.

11. The sports board of claim 1, wherein the top piece of the outer ring unit and the bottom piece of the outer ring unit each comprises concentric indentations that fit into a wrench.

12. The sports board of claim 1, wherein the bottom piece of the inner insert unit comprises a hex socket.

* * * * *